US008866693B2

(12) United States Patent
Nogami

(10) Patent No.: US 8,866,693 B2
(45) Date of Patent: Oct. 21, 2014

(54) RADIO-COMMUNICATION ANTENNA DEVICE

(75) Inventor: Hidekatsu Nogami, Kyoto (JP)

(73) Assignee: Omron Corporation, Kyoto (JP)

( * ) Notice: Subject to any disclaimer, the term of this patent is extended or adjusted under 35 U.S.C. 154(b) by 124 days.

(21) Appl. No.: 13/547,448

(22) Filed: Jul. 12, 2012

(65) Prior Publication Data

US 2013/0050028 A1 Feb. 28, 2013

(30) Foreign Application Priority Data

Aug. 26, 2011 (JP) ..... 2011-184518

(51) Int. Cl.
*H01Q 1/48* (2006.01)
*H01Q 1/38* (2006.01)
*H01Q 9/04* (2006.01)

(52) U.S. Cl.
CPC ..... *H01Q 9/0414* (2013.01); *H01Q 1/38* (2013.01); *H01Q 1/48* (2013.01); *H01Q 9/045* (2013.01)
USPC ..... 343/848; 343/700 MS

(58) Field of Classification Search
CPC ..... H01Q 1/38; H01Q 9/0407; H01Q 9/0414
USPC ..... 343/846, 848
See application file for complete search history.

(56) References Cited

U.S. PATENT DOCUMENTS 4,051,477 A 9/1977 Murphy et al.
5,706,015 A * 1/1998 Chen et al. ..... 343/700 MS
2006/0220977 A1 10/2006 Ogino

* cited by examiner

*Primary Examiner* — Robert Karacsony
(74) *Attorney, Agent, or Firm* — Karl F. Milde, Jr.; Eckert Seamans Cherin & Mellott, LLC

(57) ABSTRACT

An antenna device comprises an antenna board, wherein an antenna pattern is formed in or on a front surface of a dielectric layer, a ground layer is formed in or on a rear surface of the dielectric layer, and a feed pin is inserted into a thickness of the antenna board through the ground layer and the dielectric layer. The diameter of the antenna pattern is set to one half of the wavelength of an RF signal passed through the antenna pattern, and a length of one side of the dielectric plate is set shorter than the wavelength. A metallic plate is coupled to the ground layer with a plurality of metallic spacers interposed therebetween, whereby the metallic plate is electrically connected to the ground layer.

1 Claim, 4 Drawing Sheets

RADIO-COMMUNICATION ANTENNA DEVICE

TECHNICAL FIELD

The present invention relates to a radio-communication antenna device, particularly to an antenna device comprising a configuration of a patch antenna.

RELATED ART

In a configuration of an antenna board for a patch antenna, a conductive layer that acts as an antenna pattern is formed in or on one of the surfaces of a dielectric plate, and a ground layer is formed in or on the other surface. The antenna pattern is electrically connected to a feed pin that is inserted into a middle substrate of the antenna board, and the feed pin is electrically connected to a coaxial cable that transmits a radio frequency (RF) signal. When the RF signal from the coaxial cable is supplied to the antenna pattern through the feed pin, an electric field is generated between the antenna pattern and the ground layer to radiate a radio wave.

Japanese Unexamined Patent Publication No. 4-337907 discloses a configuration of a basic antenna board. In the antenna board disclosed in Japanese Unexamined Patent Publication No. 4-337907, a flexible board having a projected step portion at one end edge is integrally bonded without providing a ground layer in a rear surface of the antenna board. A microstrip line and the ground layer are extended to the projected step portion in a rear surface of the flexible board, and the projected step portion acts as a coaxial-cable connecting lead portion.

Japanese Unexamined Patent Publication No. 2004-72320 discloses an antenna device including a dielectric plate in which the antenna pattern (described as a patch electrode) is provided in a ceiling surface, a circuit board on which a radio frequency circuit electrically connected to the antenna pattern is mounted, and a shield case that accommodates the circuit board. In the antenna device, a ceiling plate portion of the shield case is overhung to a surrounding area of a bottom surface of the dielectric plate, and the radio frequency signal is fed to the radio frequency circuit, whereby the shield case acts as a ground.

In order to efficiently radiate a radio wave using a patch antenna, it is necessary that a width of the antenna pattern be set to one half the length of a wavelength of the radio wave. It is also necessary that an overhang width (a width of a portion outside the end edge of the antenna pattern) of the ground layer to the antenna pattern be sufficiently increased. Specifically, it is necessary that the overhang width of the ground layer be at least one half of the width of the antenna pattern. Accordingly, each side of the dielectric plate is optimally set to at least the length (that is, double the width of the antenna pattern) corresponding to the wavelength of the radio wave.

Recently there has been a demand for a compact antenna device with the breadth of an RFID system. Even if the antenna device is compact, it is necessary to radiate a radio wave having sufficient intensity.

As described above, the size of the antenna pattern or the antenna board is determined with respect to the wavelength of the radio wave. In the antenna board, the wavelength of the radio wave is shortened by a wavelength shortening effect of the dielectric material. Because the wavelength shortening effect increases with increasing permittivity, when the dielectric plate is made of high-permittivity material, the wavelength of the radio wave is largely shortened, and the size of the dielectric plate can be reduced according to the shortened wavelength.

However, gain is decreased because the use of the high-permittivity board reduces an aperture area. In order to increase the gain, it is necessary to enlarge the dielectric plate. However, such a compact antenna device is not desired due to the high cost of the high-permittivity material.

On the other hand, when the dielectric plate is made of low-permittivity material, gain is enhanced, and the cost can be lowered. However, because the wavelength of the radio wave cannot effectively be shortened, the size of the dielectric plate is hardly reduced.

Thus, in the antenna device of the related art, a useful compact antenna device and high gain are hard to achieve at the same time. The present invention has been devised to solve the problems described above, and an object thereof is to provide a compact antenna device in which high gain is obtained at reasonable cost.

SUMMARY OF THE INVENTION

In accordance with one aspect of the present invention, an antenna device includes an antenna board in which an antenna pattern is formed in or on one of the surfaces of a dielectric plate while a ground layer is formed in or on the other surface, and a feed pin is disposed in a middle substrate or portion of the antenna device in order to feed electric power or a signal to the antenna pattern, wherein a metallic plate is disposed facing the ground layer side of the antenna board, and the metallic plate and the ground layer are coupled and electrically connected through a plurality of metallic spacers.

According to the above configuration, the current passed through the ground layer by the generation of an electric field propagates partially to the spacers and the metallic plate, and the metal located within the propagation area acts as a ground connected to the ground layer. Therefore, the radiation efficiency can sufficiently be enhanced even if the overhang width of the ground layer to the antenna pattern is insufficient. Because the permittivity is relatively low, even if the dielectric plate is made of a material in which the wavelength shortening effect is low because of relatively-low permittivity, the length of one side of the dielectric plate can be made shorter than the wavelength of the radio wave, which allows production of a compact antenna board. The use of low-permittivity material can enlarge the antenna pattern even if the size of the board is reduced. That is, because the aperture area can be increased, high gain can be ensured. Additionally the cost can be lowered.

In the antenna device disclosed in Japanese Unexamined Patent Publication No. 2004-72320, the function of the ground is complemented by the shield case below the dielectric plate. However, because the whole surface of the dielectric plate is brought into close contact with the shield case, no feature of the present invention is described in Japanese Unexamined Patent Publication No. 2004-72320. In the antenna device disclosed in Japanese Unexamined Patent Publication No. 2004-72320, the circuit board is disposed in the shield case, and the coaxial cable and the feed pin are connected through circuit board, which results in the complicated configuration. On the other hand, in the antenna device of an aspect of the invention, because the antenna board and the metallic plate are coupled with spacers interposed therebetween, a simple configuration is achieved.

As described below, because a coaxial cable can be inserted into the gap between the antenna board and the metallic plate and connected to the antenna board, the coaxial cable does not project from the backside of the antenna device. Therefore, the antenna device can easily be attached to a wall surface.

In the antenna device in accordance with an aspect of the invention, preferably a conductor pattern is formed in the ground-layer forming surface of the antenna board within in a predetermined area including a connection point to the feed pin while separated from the ground layer. A coaxial cable is inserted into a gap between the antenna board and the metallic plate, and an inner conductor of the coaxial cable is connected to the conductor pattern while an outer conductor of the coaxial cable is connected to the ground layer.

In the antenna device in accordance with an aspect of the invention, preferably a first conductor pattern is formed in a predetermined area comprising a connection point to the feed pin while separated from the ground layer in the ground-layer forming surface of the antenna board, and a second conductor pattern is formed near the first conductor pattern while separated from first conductor pattern and the ground layer. The first and second conductor patterns are connected in series through a capacitor. A coaxial cable is inserted into a gap between the antenna board and the metallic plate, and an inner conductor of the coaxial cable is connected to the second conductor pattern while an outer conductor of the coaxial cable is connected to the ground layer.

Because the gain of the antenna is enhanced with increasing area of the dielectric plate, it is necessary to increase the thickness of the dielectric plate in order to ensure the gain without changing the area of the dielectric plate. However, when the thickness of the dielectric plate is increased, because a reactance or resistance component is generated by the length of the feed pin, it is necessary to provide a circuit that cancels the reactance or resistance component.

In the antenna device of an aspect of the invention, in consideration of this problem, the inner conductor of the coaxial cable and the feed pin are connected in series through an impedance converting capacitor. The reactance or resistance component of the feed pin is cancelled by the capacitor, and the impedance of the RF-signal route in the antenna board can be matched with the impedance of the coaxial cable. Therefore, the gain can be enhanced by the thickness of the board without degrading the radiation efficiency.

According to the invention, even if the overhang width of the ground layer to the antenna pattern is insufficient, the function of the ground is complemented by the metallic spacers and the metallic plate coupled to the metallic spacers, and the radio wave can be radiated without trouble. Therefore, even if low-permittivity material is used, the size of the dielectric plate can be reduced, the gain can be enhanced, and, in addition, the cost can be reduced or maintained.

Accordingly, a compact antenna device in which high gain is obtained can be provided at reasonable cost.

DETAILED DESCRIPTION

Figure 1A:
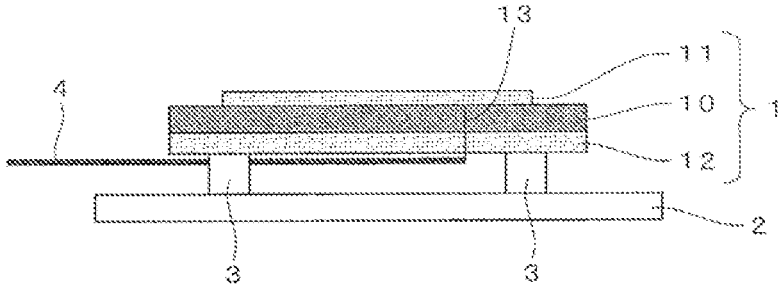
FIGS. 1A and 1B are a side view and a front view, respectively, illustrating a configuration of a main part of an antenna device according to an embodiment of the invention.

Embodiments of a compact antenna device according to the invention will be described with reference to FIGS. 1A to 4. Identical elements shown in the various figures are designated with the same reference numerals.

Figure 1B:
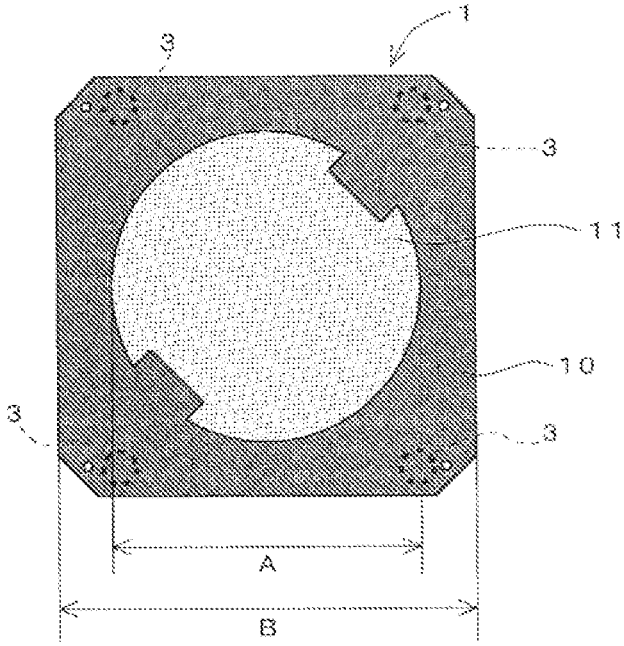

FIGS. 1A and 1B each illustrate a configuration of a main part of an RFID-system antenna device according to an embodiment of the invention. FIG. 1A is a side view of the main part, and FIG. 1B is a front view of the main part.

The main part of the antenna device of the embodiment comprises a coupled body of an antenna board 1 and a metallic plate 2. In a configuration of the antenna board 1, front-surface-side conductive layer 11 and rear-surface-side conductive layer 12 are formed in or on both surfaces of a square dielectric plate 10, in which the four corners are cut off. The front-surface-side conductive layer 11 has a circular shape, in which two arcs disposed opposite each other are notched, and acts as an antenna pattern. The rear-surface-side conductive layer 12 extends substantially the whole rear surface of dielectric plate 10 and acts as a ground layer. The antenna pattern 11 is not limited to a circular shape, but may have a square shape instead.

Ends of metallic spacers 3 are coupled or fastened to the four corners of the antenna board 1, and the metallic plate 2 is coupled to the other end of each of the spacers 3. Metallic plate 2 is a rectangular, plate-like body or substrate that is slightly larger in longitudinal and latitudinal (planar) directions than the antenna board 1. A lower surface of the ground layer 12 of the antenna board 1 is covered with a resist, except that the resist has been removed or was not applied in the areas where each spacer 3 is coupled to the ground layer 12. Therefore, the ground layer 12, the spacers 3, and the metallic plate 2 are integrated, and electrically connected.

A passageway or conduit 13 comprising a conductor is positioned properly into and through dielectric substrate 10 in the antenna board 1, and the conduit 13 acts as a feed pin 13. The feed pin 13 is electrically connected to the antenna pattern 11. A coaxial cable 4 is inserted in a gap between the antenna board 1 and the metallic plate 2 to transmit an RF signal. The coaxial cable 4 is introduced near a connection point to the feed pin 13 along a rear surface of the antenna board 1, and an outer conductor and an inner conductor of the coaxial cable 4 are electrically connected to the ground layer 12 and the feed pin 13, respectively. Because of the connection, the RF signal is introduced to the antenna pattern 11 through the feed pin 13, and an electric field is generated between the antenna pattern 11 and the ground layer 12 to radiate a radio wave.

In FIG. 1B, A is a diameter of the antenna pattern 11 and B is a length of one side of the dielectric plate 10.

In a patch antenna, ideally a width length of the antenna pattern is set to one half of a wavelength of the radio wave, and an overhang width of the ground layer to the antenna pattern is set to $\lambda/4$ or more. Accordingly, it is necessary that one side of the dielectric plate 10 be at least the length of one wavelength.

That is, desirably $B \geq 2 \times A$ is obtained, when the above condition is expressed by A and B in FIG. 1B.

However, as illustrated in FIG. 1B, the length B of one side of the dielectric plate 10 is much shorter than two times A. Accordingly, even for $A=\lambda/2$, the overhang width of the rear-surface ground layer 12 of the rear surface from the antenna pattern 11 is too small, and possibly radiation efficiency of the radio wave is insufficiently enhanced by only the antenna board 1.

However, in the embodiment of the invention shown, a current passed through the ground layer 12 propagates to the spacers 3 and the metallic plate 2, which are coupled to the ground layer 12, so that a metallic material located within an area of the current propagation can act as a ground connected to the ground layer 12. Particularly, the current is efficiently passed along a lengthwise direction of the spacers 3 by forming the spacers 3 directly coupled to the ground layer 12 into a columnar shape, so that the ground layer 12 that is deficient in an area to radiate the radio wave can be complemented. Therefore, the radio wave can be stably radiated.

In the embodiment of the invention, the columnar spacer 3 is used. Alternatively, for example, the spacers 3 having a prismatic column shape or a triangular prism shape may be used. The number of spacers 3 is not limited to four, but more than four spacers 3 may be provided.

There is no particular limitation to a material for the spacers 3 or the metallic plate 2. For example, iron, aluminum, and stainless steel may be used. The overhang width of the metallic plate 2 to the antenna board 1 can be adjusted as needed but not so much as to cause difficulty in supporting a later-described redome 6.

According to the antenna device having the above configuration according to the invention, the dielectric plate 10 is made of a material having a relatively low permittivity. Therefore, the size of the antenna board 1 can be reduced while gain is enhanced to lower the cost.

The reason these effects are obtained will be described below.

The radio wave in the antenna board 1 is shortened according to the permittivity of the dielectric plate 10. Specifically, assuming that $\in r$ is permittivity, the shortened wavelength $\lambda$ becomes about $1/\sqrt{\in r}$ times the original wavelength.

Accordingly, when the dielectric plate 10 is produced using high-permittivity material, the wavelength can largely be shortened.

As described above, in the patch antenna of the related art, desirably the length of one side of the dielectric plate 10 is set to at least the wavelength $\lambda$ of the radio wave. From the viewpoint of the wavelength shortening effect, the wavelength of the radio wave is largely shortened using the high-permittivity dielectric plate 10, whereby the size of the dielectric plate 10 can be reduced while the desirable condition is satisfied.

For example, a radio wave in a UHF band (860 to 950 MHz) has a wavelength of about 30 cm, and the wavelength in the antenna board 1 is shortened to about 12 cm when the permittivity $\in r$ of the dielectric plate 10 is set to 6. The antenna pattern 11 having the diameter of 6 cm can be formed in or on the dielectric plate 10 having one side of 12 cm. However, as illustrated in FIG. 2, the gain is largely decreased with increasing permittivity of the dielectric plate 10.

Figure 2:
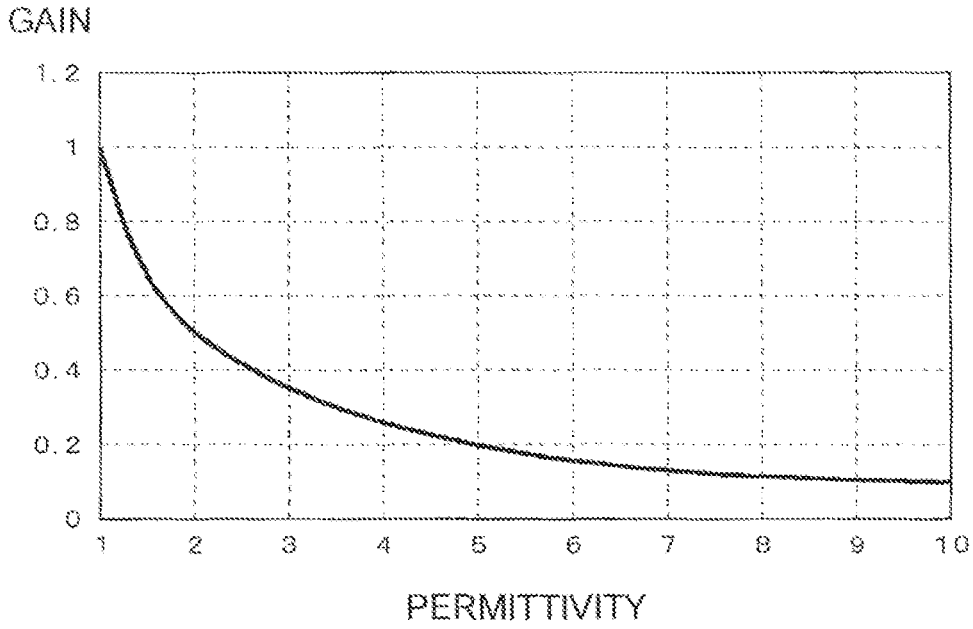
FIG. 2 is a graph illustrating a relationship between permittivity and gain.

FIG. 2 illustrates a relationship between the permittivity and the gain when a volume, a frequency band, and radiation efficiency of the antenna board 1 are kept constant. The gain is normalized with the gain having the permittivity of 1 (permittivity of air).

According to the graph in FIG. 2, the gain for the permittivity $\in r$ of 6 is lower than 0.2 times the gain for the permittivity of 1.

When the frequency band and the radiation efficiency (or loss) are designed to the same degree, the gain of the radio wave radiated from the antenna board 1 is substantially proportional to the volume of the dielectric plate 10. Accordingly, the gain significantly decreases with decreasing area of the high-permittivity dielectric plate 10. Because there is a restriction to the increase of the thickness of the dielectric plate 10, it is necessary to enlarge the surface area of the dielectric plate 10 in order to enhance the gain. However, in this case, the size of the dielectric plate 10 cannot be reduced.

When the dielectric plate 10 is made of low-permittivity material, the wavelength shortening effect of the radio wave is decreased while the gain can be enhanced. Accordingly, in this case the size of the antenna board 1 is hardly reduced.

Thus, in the patch antenna of the related art, it is difficult to simultaneously implement the miniaturization of the antenna board 1 and the high gain.

On the other hand, in the antenna device having the configuration in FIGS. 1A and 1B, the function of the ground is complemented by the spacers 3 and the metallic plate 2, so that the length B of one side of the antenna board 1 can be made shorter than the wavelength $\lambda$. Accordingly, even if the dielectric plate 10 is made of the relatively-low-permittivity material, the dielectric plate 10 can be reduced within an area where the diameter A of the antenna pattern 11 can be set to $\lambda/2$. The gain can be enhanced by decreasing the permittivity.

For example, in the graph in FIG. 2, when the permittivity $\in r$ is set to around 3.5, the gain is obtained about double that of the permittivity of 6. When the permittivity $\in r$ is 3.5, because the wavelength of 30 cm can be shortened to about 16 cm, the diameter A of the antenna pattern 11 can be set to about 8 cm. Accordingly, when the length of one side of the dielectric plate 10 made of the material having a permittivity $\in r$ of 3.5 is set to 12 cm that is equal to the wavelength shortened using the material having the permittivity $\in r$ of 6, the higher gain can be obtained compared with the permittivity $\in r$ of 6. When the gain has a margin, one side of the dielectric plate 10 can be made shorter than 12 cm (however, more than 8 cm).

A connection state between the antenna board 1 and the coaxial cable 4 will be described with reference to FIGS. 3A and 3B.

Figure 3A:
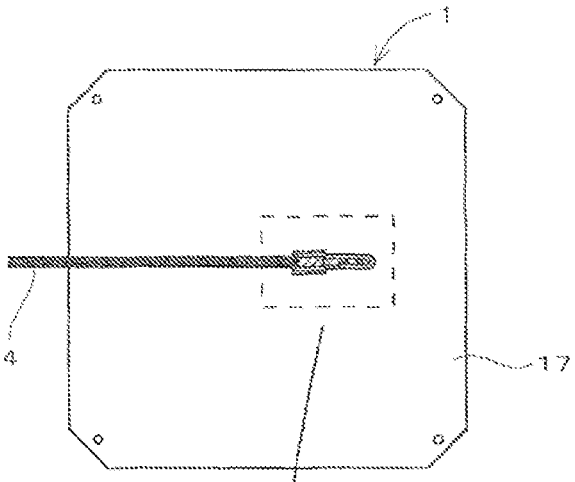
FIG. 3A is a front view illustrating an entire configuration on a rear surface side of an antenna board.
Figure 3B:
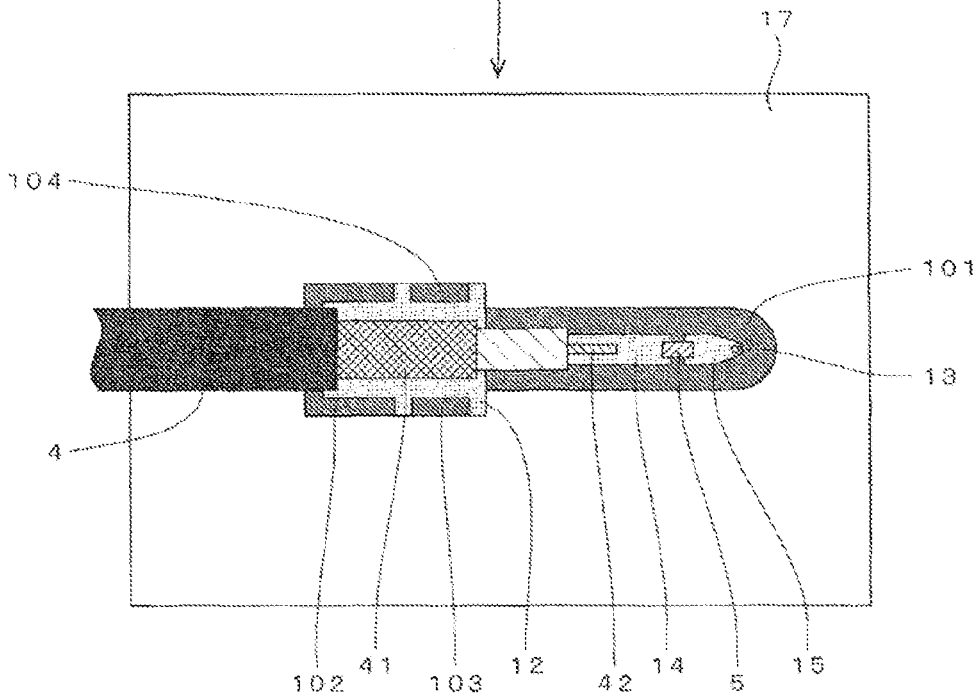
FIG. 3B is an enlarged view of a connection point to a coaxial cable.

FIG. 3A illustrates an entire configuration of the rear surface of the antenna board 1 together in relation to the coaxial cable 4, and FIG. 3B is an enlarged view in the area (within the dotted-line frame in FIG. 3A) of the point connected to the coaxial cable 4. A white portion 17 in FIGS. 3A and 3B represents a resist that covers the ground layer 12; the actual resist has a green color.

The resist 17 is removed in the area corresponding to a leading end portion of the coaxial cable 4 in addition to the areas coupled to the spacers 3, and the ground layer 12 is exposed in part of the area corresponding to the leading end portion of the coaxial cable 4A. Microstrip line 14 and a small conductor pattern 15 are formed in a band-shape region 101 beside the exposed portion with a micro gap. The feed pin 13 is provided by the passageway or conduit between the conductor pattern 15 and a point corresponding to the conductor pattern 15 on the front-surface side of dielectric plate 10.

Because the conductive layer around the microstrip line 14 and the conductor pattern 15 is removed, the microstrip line 14 and the conductor pattern 15 are electrically independent from the ground layer 12. At the point where the ground layer 12 is exposed, conductive-layer removing regions 102, 103, and 104 are formed along a peripheral border of the ground layer 12, and the regions 102, 103, and 104 act as a thermal barrier or sink. The point where the ground layer 12 is exposed is coupled to the ground layer 12 at the point, where the resist 17 is covered, with the thermal lands 102, 103, and 104 interposed therebetween.

An outer conductor 41 of the coaxial cable 4 is connected to the point where the ground layer 12 is exposed, and an inner conductor 42 of the coaxial cable 4 is connected to the microstrip line 14. The leading end portion of the microstrip line 14 and the conductor pattern 15 are connected to each other through the capacitor 5.

In order to enhance the gain without changing the area of the plate surface of the dielectric plate 10, the thickness of the dielectric plate 10 may be increased. However, in this case, there is a reactance or resistance component due to the length of the feed pin 13. On the other hand, in the example in FIGS. 3A and 3B, because the coaxial cable 4 and the feed pin 13 are connected in series through the capacitor 5, the reactance or resistance component generated by the feed pin 13 is cancelled by the capacitor 5, and impedance of an RF signal route on the side of the antenna board 1 can be matched with impedance of the coaxial cable 4. Therefore, the radio wave from the antenna pattern 1 can be efficiently radiated.

When the reactance or resistance component of the feed pin 13 is not considered because of the thin dielectric plate 10, the microstrip line 14 and the conductor pattern 15 are integrated without the capacitor 5, and the inner conductor 42 of the coaxial cable 4 may be connected to the integrated microstrip line 14 and conductor pattern 15.

Figure 4:
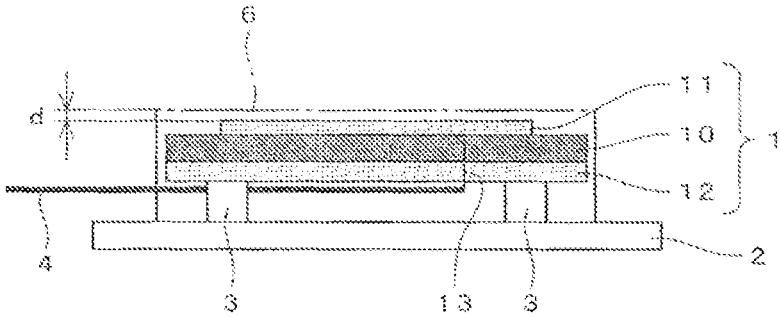
FIG. 4 is a view illustrating a relationship between a redome and a coupled body of the antenna board and a metallic plate.

FIG. 4 illustrates an embodiment of the invention in which the coupled body of the antenna board 1 and the metallic plate 2 is covered with a redome 6. The redome 6 is a resin case in which a bottom surface is opened, and an opening end edge of the redome 6 is supported by the overhang portion of the metallic plate 2. A hole (not illustrated) is made in a lateral surface of the redome 6 in order to insert the coaxial cable 4, and the coaxial cable 4 inserted through the hole is connected to the rear surface of the antenna board 1.

According to the above configuration, because the rear surface of the metallic plate 2 constitutes a back side of the antenna device, the connection portion of the coaxial cable 4 is not exposed to the rear surface, and the antenna device can easily be attached to a wall surface.

When the redome 6 is made of a heat-resistant, chemical-resistant material, the antenna board 1 can well be protected irrespective of an installation environment. Specifically, PPS resin is an example of the heat-resistant, chemical-resistant material.

However, when the permittivity of the dielectric plate 10 is set to around 3.5, the permittivity (permittivity of about 4) of the PPS resin is higher than that of the dielectric plate 10. When the antenna board 1 is brought into close contact with the redome 6, the wavelength shortening effect of the radio wave is enhanced in the antenna board 1 by an influence or effect of the permittivity of the redome 6, and possibly the gain is decreased. Therefore, in this embodiment, a gap is preferably provided between a front plate of the redome 6 and the antenna board 1.

The gap is adjusted by measuring a distance d (see FIG. 4) between the front plate of the redome 6 and the antenna board 1 in designing the antenna device. Depending on the change of the distance d, the diameter A of the antenna pattern 11 and the position of the feed pin 13 are also changed incrementally to ensure a setting state in which the proper gain is obtained.

In another embodiment of the invention, the antenna device, a second antenna board 1 on which a passive element is mounted can be disposed between the antenna board 1 and the redome 6. In this case, a distance between the second antenna board 1 and the redome 6 and a distance between the antenna boards 1 are adjusted on the assumption that the gaps are provided between the second antenna board 1 and the redome 6 and between the antenna boards 1.

There has thus been shown and described a novel antenna device using the same which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. An antenna device comprising:

an antenna board comprising:

a dielectric plate having a first surface and a second surface;

an antenna pattern in or on the first surface of the dielectric plate; and a ground layer formed in or on the second surface of the dielectric plate;

a metallic plate disposed facing the ground layer of the antenna board; and a plurality of metallic spacers connecting the ground layer of the antenna board to the metallic plate, wherein a feed pin is disposed through the ground layer and the dielectric plate to feed electric power or a signal to the antenna pattern;

wherein the metallic plate and the ground layer are coupled and electrically connected through the plurality of metallic spacers;

wherein a first conductor pattern is formed in a predetermined area including a connection point to the feed pin while separated from the ground layer in the ground-layer forming surface of the antenna board, a second conductor pattern is formed near the first conductor pattern while separated from first conductor pattern and the ground layer, wherein the first and second conductor patterns are connected in series through a capacitor; and wherein a coaxial cable is inserted in a gap between the antenna board and the metallic plate, and an inner conductor of the coaxial cable is connected to the second conductor pattern while an outer conductor of the coaxial cable is connected to the ground layer.

* * * * *